US009960514B1

(12) United States Patent
Chen

(10) Patent No.: US 9,960,514 B1
(45) Date of Patent: May 1, 2018

(54) DOUBLE-SIDED PLUGGABLE POWER PLUG, POWER SOCKET AND COMBINATION STRUCTURE THEREOF

(71) Applicant: Oupiin Electronic (Kunshan) Co., Ltd., Kunshan (CN)

(72) Inventor: Hsin-chih Chen, Kunshan (CN)

(73) Assignee: OUPIIN ELECTRONIC (KUNSHAN) CO., LTD., Kunshan (CN)

( * ) Notice: Subject to any disclaimer, the term of this patent is extended or adjusted under 35 U.S.C. 154(b) by 0 days. days.

(21) Appl. No.: 15/462,860

(22) Filed: Mar. 19, 2017

(30) Foreign Application Priority Data

Oct. 28, 2016 (CN) ..... 2016 1 0965839

(51) Int. Cl.

| | |
|---|---|
| ***H01R 13/04*** | (2006.01) |
| ***H01R 13/11*** | (2006.01) |
| ***H01R 24/68*** | (2011.01) |
| ***H01R 24/76*** | (2011.01) |
| ***H01R 13/187*** | (2006.01) |
| *H01R 103/00* | (2006.01) |

(52) U.S. Cl.
CPC ..... *H01R 13/04* (2013.01); *H01R 13/113* (2013.01); *H01R 13/187* (2013.01); *H01R 24/68* (2013.01); *H01R 24/76* (2013.01); *H01R 2103/00* (2013.01)

(58) Field of Classification Search
CPC ..... H01R 13/04; H01R 13/113; H01R 24/68; H01R 24/76; H01R 2103/00; H01R 13/05; H01R 13/187
USPC ..... 439/682, 845, 850, 862, 948
See application file for complete search history.

(56) References Cited

U.S. PATENT DOCUMENTS

| | | | | |
|---|---|---|---|---|
| 6,918,800 | B2 * | 7/2005 | Ota | H01R 13/03 439/181 |
| 7,104,812 | B1 * | 9/2006 | Bogiel | H01R 12/724 439/79 |
| 8,159,836 | B2 * | 4/2012 | Pizzi | H01R 9/2458 310/216.048 |
| 8,419,474 | B2 * | 4/2013 | Zhang | G02B 6/3817 439/607.25 |
| 8,435,043 | B2 * | 5/2013 | Yu | H01R 12/7088 439/65 |
| 8,439,697 | B2 * | 5/2013 | Vass | H01R 13/6395 439/270 |
| 8,545,275 | B2 * | 10/2013 | Wang | H01R 13/44 439/680 |
| 8,968,009 | B2 * | 3/2015 | Chen | H01R 12/7088 439/79 |

(Continued)

*Primary Examiner* — Tulsidas C Patel
*Assistant Examiner* — Travis Chambers
(74) *Attorney, Agent, or Firm* — JMB Davis Ben-David

(57) ABSTRACT

A double-sided pluggable combination structure is disclosed in this invention, which includes a double-sided pluggable power plug and a double-sided pluggable power socket. When the power plug and the power socket are engaged with each other, an insertion part of the power socket can enter into a receiving cavity from a plug port of the power plug by an obverse insertion mode or a reverse insertion mode, and each plug terminal of the power plug can be inserted into an insertion hole from a corresponding socket port of the power socket. An engaged portion of the plug terminal can be clamped by elastic arms of a socket terminal, thereby forming a stable electric contact between the plug terminal and the socket terminal.

10 Claims, 20 Drawing Sheets

(56) References Cited

U.S. PATENT DOCUMENTS

2008/0261420 A1* 10/2008 Riddle ..... H01R 13/44
439/134

* cited by examiner

DOUBLE-SIDED PLUGGABLE POWER PLUG, POWER SOCKET AND COMBINATION STRUCTURE THEREOF

CROSS REFERENCE TO RELATED APPLICATIONS

Benefit is claimed to Chinese Patent Application No. 201610965839.8, filed Oct. 28, 2016, the contents of which are incorporated by reference herein in their entirety.

BACKGROUND OF THE INVENTION

1. Field of the Invention

The present invention relates to a connector technology, and more particularly to a double-sided pluggable power plug, a double-sided pluggable power socket and a double-sided pluggable combination structure thereof.

2. Description of the Prior Art

At present, the technical parameters of electronic devices such as the transmission rate are improved, but the most interesting thing is that some interfaces (such as USB interface) of the electronic devices have the double-sided pluggable characteristic, which is more user-friendly for many users.

Based on the above market demand, the applicant starts to study how to make more power connectors have the double-sided pluggable characteristic, rather than just USB connector.

BRIEF SUMMARY OF THE INVENTION

One object of the present invention is to provide a double-sided pluggable power plug, a plug housing of which is designed to be double-sided pluggable, and plug terminals of which are designed to have great structural strength and safety.

Another object of the present invention is to provide a double-sided pluggable power socket, a socket housing of which is designed to be double-sided pluggable.

The other object of the present invention is to provide a double-sided pluggable combination structure, which includes a power plug and a power socket having the double-sided pluggable characteristic.

Other objects and advantages of the present invention may be further understood from the technical features disclosed by the present invention.

To achieve the aforementioned object or other objects of the present invention, the present invention adopts the following technical solution.

The present invention provides a double-sided pluggable power plug, which comprises a plug housing, a pair of plug terminals mounted on the plug housing and a rear cover mounted on the rear of the plug housing. The plug housing has a rectangular plug port on the front thereof, a receiving cavity extending rearward from the plug port, and a pair of plug terminal-receiving passages extending forward through the receiving cavity from the rear of the plug housing and extending downward through the bottom of the plug housing. Each plug terminal-receiving passage forms a pair of crossbeams located on two sides thereof and spaced apart from each other. Each plug terminal includes two conductive plates symmetrically arranged and closely attached to each other. Each conductive plate has a vertical plate, a platelike engaged portion on the front of the vertical plate, and a vertical tail being bent outward from the bottom of the vertical plate and extending downward. The conductive plate further includes a first fixed protrusion being formed on the vertical plate and protruding outward, and a pair of second fixed protrusions located under the first fixed protrusion and above the tail. When the plug terminal is mounted on the plug housing, the vertical plate is inserted into the corresponding plug terminal-receiving passage and is clamped by the pair of crossbeams; the engaged portion enters into the receiving cavity; and the tail extends out of the bottom of the plug housing.

In one embodiment, the plug terminal further includes an insulation head disposed on the front of the engaged portions of the two conductive plates.

In one embodiment, the vertical plate of one conductive plate of the plug terminal has a third fixed protrusion protruding toward the other conductive plate; and the vertical plate of the other conductive plate has a rectangular opening for allowing the third fixed protrusion to enter therein.

In one embodiment, the plug housing further includes a plug recess on the rear of the plug housing; and the rear cover is T-typed and is accommodated in the plug recess.

In one embodiment, the plug housing further includes two plug-fixed structures respectively on both sides of the plug housing for being used to receive and fix a fastener.

The present invention also provides a double-sided pluggable power socket, which comprises a socket housing, a pair of socket terminals mounted on the socket housing and a rear plate mounted on the rear of the socket housing. The socket housing has an insertion part with a square section in the front of the socket housing, a mounting part connected with the insertion part in the rear of the socket housing, a pair of socket ports formed in the front of the insertion part, and a pair of socket terminal-receiving passages extending forward from the rear of the mounting part unto the socket port and extending downward to pass through the bottom of the mounting part. Each socket port includes an insertion hole in the middle thereof, and multiple long grooves symmetrically formed on two sides of the insertion hole and communicated with the insertion hole. The mounting part forms a shoulder next to the insertion part. Each socket terminal includes two symmetrically arranged conductive pieces. Each conductive piece has a vertical part, multiple elastic arms located on the front of the vertical part and formed by being bent, and multiple vertical end parts extending downward from the bottom of the vertical part; the elastic arms of the two conductive pieces forming a clip. Each conductive piece further dispose a protrusion part on the vertical part for mechanically connecting the two conductive pieces or making the two conductive pieces contact each other. When the socket terminal is mounted on the socket housing, the vertical part is inserted into the corresponding socket terminal-receiving passage; these elastic arms respectively enter into the corresponding long grooves and are exposed in the corresponding insertion hole; and these end parts extend out of the bottom of the mounting part of the socket housing.

In one embodiment, the socket housing further has a socket recess on the rear thereof; and the rear plate is T-shaped and is accommodated in the socket recess.

In one embodiment, the socket housing further disposes two socket-fixed structures respectively on both sides of the socket housing for being used to receive and fix a fastener.

The present invention further provides a double-sided pluggable combination structure, which comprises a double-sided pluggable power plug and a double-sided pluggable power socket, when the power plug and the power socket are engaged with each other, the insertion part of the power socket is obversely or reversely inserted into the receiving cavity from the plug port of the power plug; the plug terminals of the power plug are inserted into the corresponding insertion holes from the corresponding socket ports; and the engaged portions of each plug terminal are clamped by the elastic arms of the corresponding socket terminal; whereby the power plug and the power socket forms a stable electrical contact therebetween.

In one embodiment, the plug terminal further includes an insulation head disposed on the front of the engaged portions of the two conductive plates. The vertical plate of one conductive plate of the plug terminal has a third fixed protrusion protruding toward the other conductive plate. And the vertical plate of the other conductive plate has a rectangular opening for allowing the third fixed protrusion to enter therein.

In comparison with the prior art, the power plug of the present invention provides the plug housing with the square receiving cavity, and the power socket of the present invention provides the insertion part with a square section, so the square insertion part can be obversely or reversely inserted into the square receiving cavity. Therefore the combination structure of the present invention has the double-sided pluggable characteristic. Moreover, the plug terminal of the power plug employs the insulation head to cover the front of the plug terminal, thereby making the plug terminal be more compact, improving the strength of the plug terminal, and avoiding avoid the burning of the front of the plug terminal in the process of hot plug and pull. In addition, in the other embodiment, the plug terminal of the power plug is provided with special mechanical connection structures, such as the third fixed protrusion and the rectangular opening, which can make the plug terminal be more firm and improve the stability of the whole structure.

DETAILED DESCRIPTION OF THE PREFERRED EMBODIMENTS

The following description of every embodiment with reference to the accompanying drawings is used to exemplify a specific embodiment, which may be carried out in the present invention. Directional terms mentioned in the present invention, such as "up", "down", "front", "back", "left", "right", "top", "bottom" etc., are only used with reference to the orientation of the accompanying drawings. Therefore, the used directional terms are intended to illustrate, but not to limit, the present invention.

Figure 1:
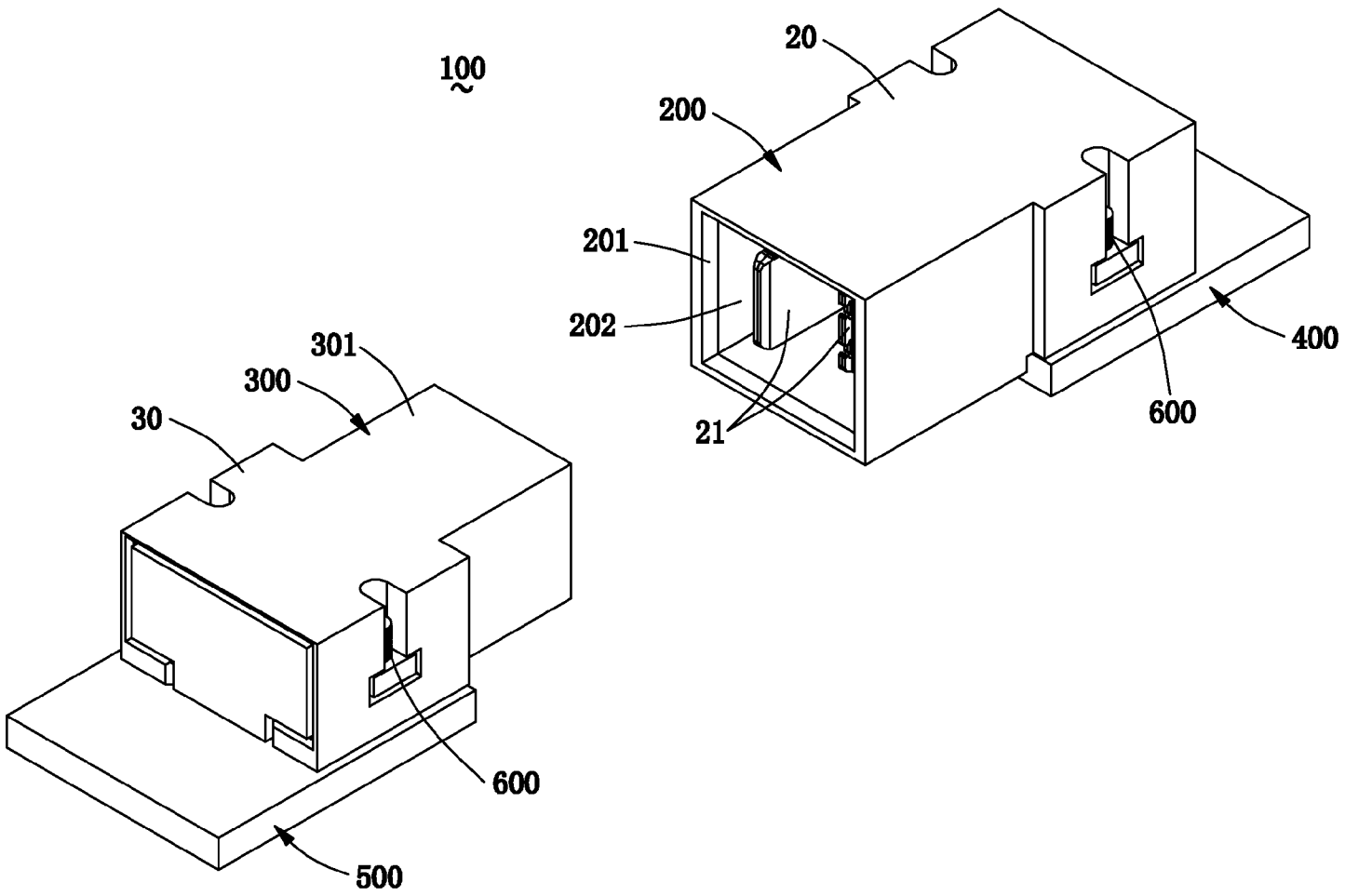
FIG. 1 is a perspective view of a double-sided pluggable combination structure of the present invention, and shows an obverse insertion state of a power plug and a power socket before being engaged together.
Figure 2:
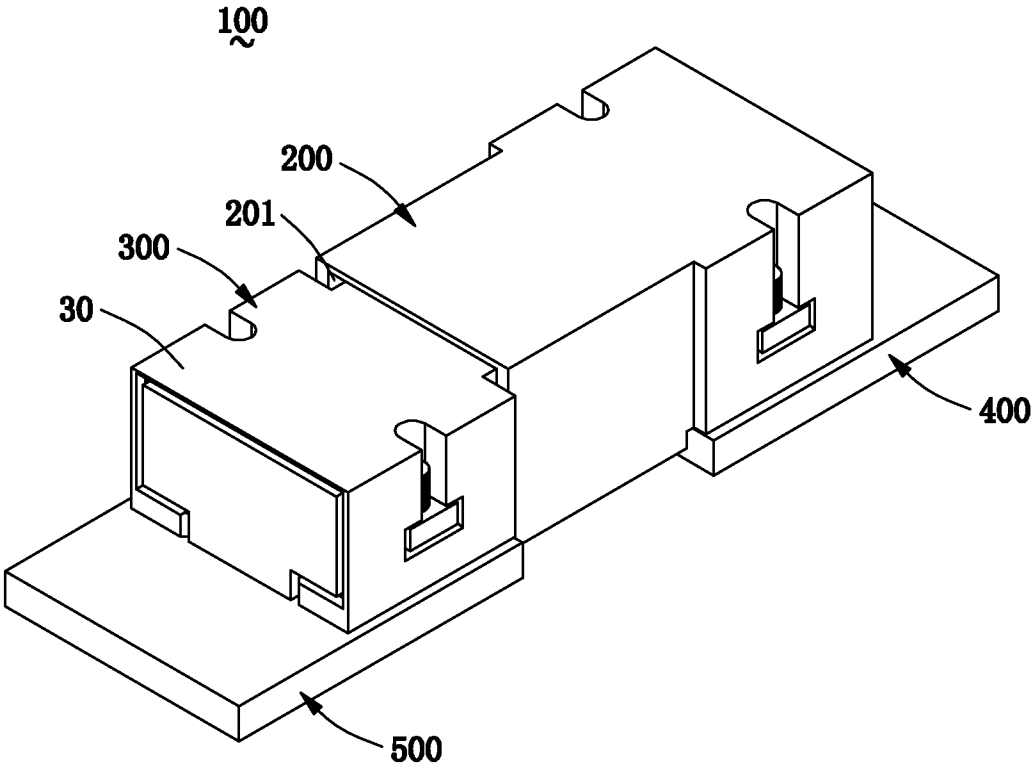
FIG. 2 is a perspective view of the double-sided pluggable combination structure of the present invention, and shows the obverse insertion state of the power plug and the power socket after being engaged together.
Figure 3:
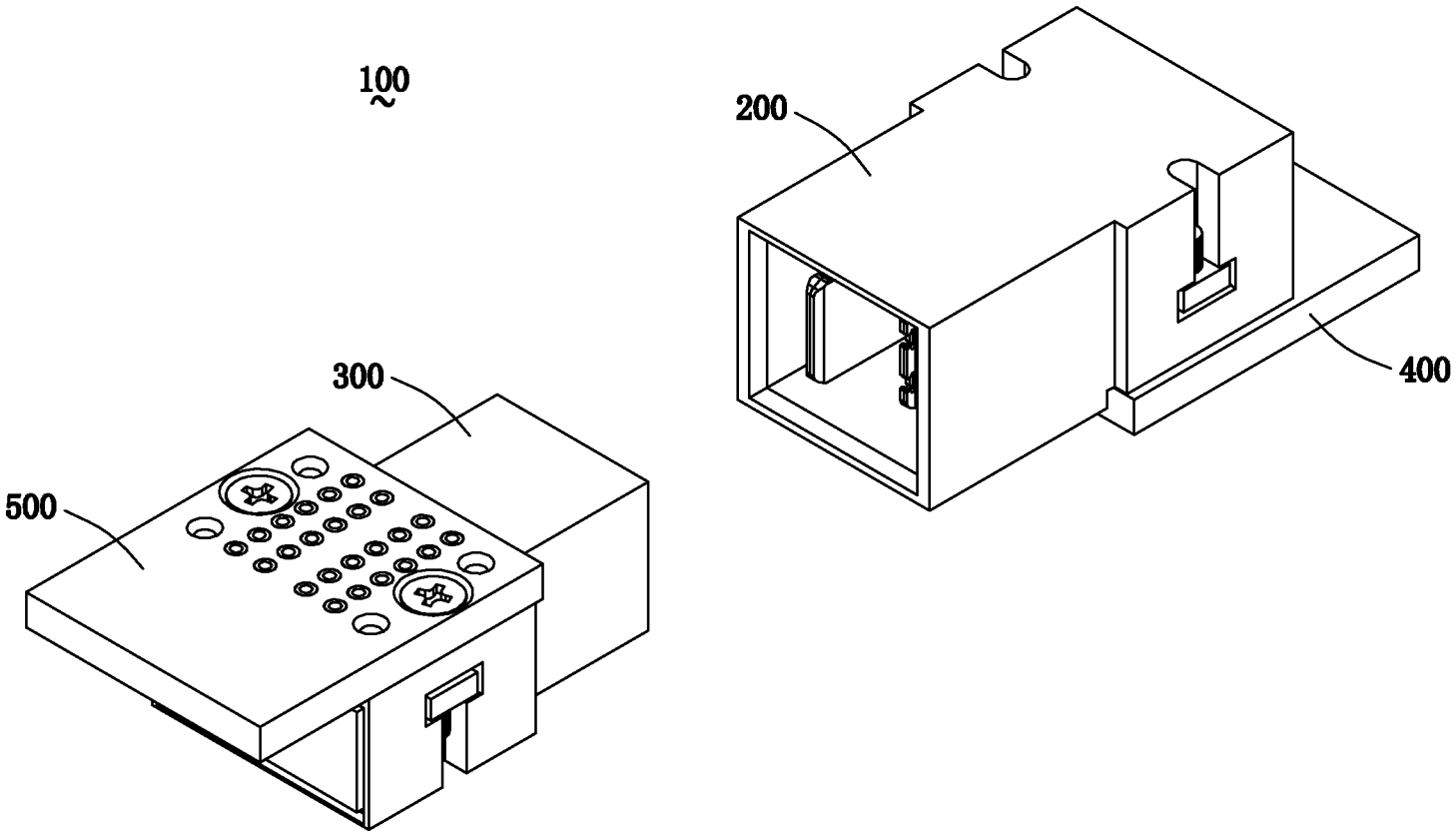
FIG. 3 is a perspective view of the double-sided pluggable combination structure of the present invention, and shows a reverse insertion state of the power plug and the power socket before being engaged together.
Figure 4:
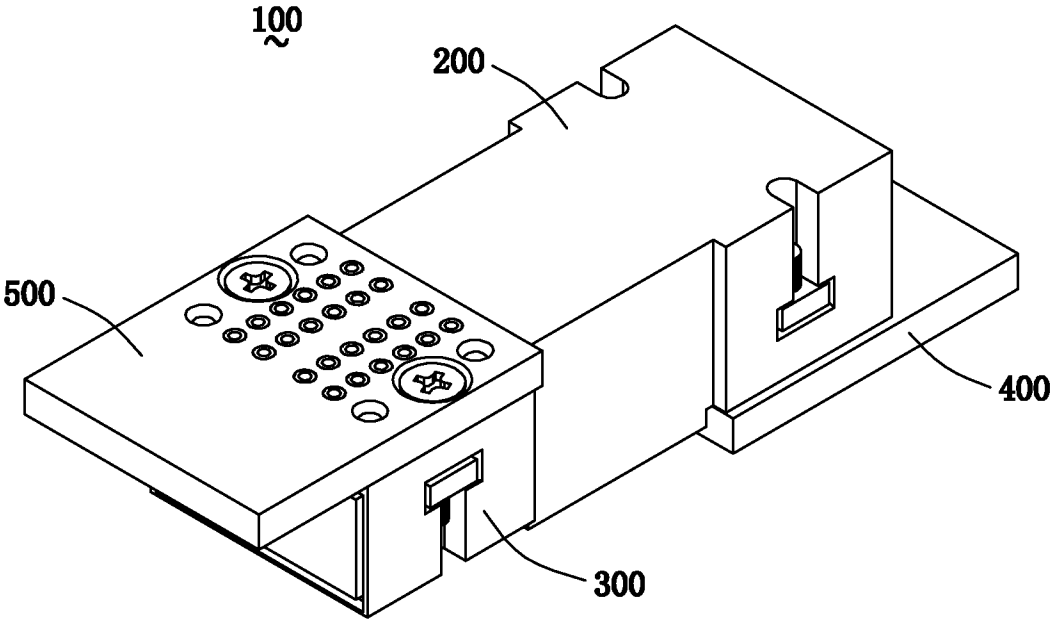
FIG. 4 is a perspective view of the double-sided pluggable combination structure of the present invention, and shows the reverse insertion state of the power plug and the power socket after being engaged together.

Please refer to FIGS. 1 to 4, a double-sided pluggable combination structure 100 of the present invention includes a double-sided pluggable power plug 200 and a double-sided pluggable power socket 300. The power plug 200 is a right-angle connector mounted on a first horizontal circuit board 400, and the insertion direction of the power plug 200 is parallel to the first horizontal circuit board 400. The power socket 300 is a right-angle connector mounted on a second horizontal circuit board 500, and the insertion direction of the power socket 300 is parallel to the second horizontal circuit board 500. Referring to FIGS. 2 and 4, the power plug 200 can be mated with the power socket 300 in an obverse insertion mode or in a reverse insertion mode. Namely, one connector (e.g. the power socket 300) is turned up and down 180 degrees, but the other connector (e.g. the power plug 200) remains unchanged, then the both can still be normally mated together.

The following text will describe the power plug 200 and the power socket 300 in detail.

Please refer to FIGS. 5 to 9, the power plug 200 includes a plug housing 20, a pair of plug terminals 21 and a rear cover 22.

Figure 8:
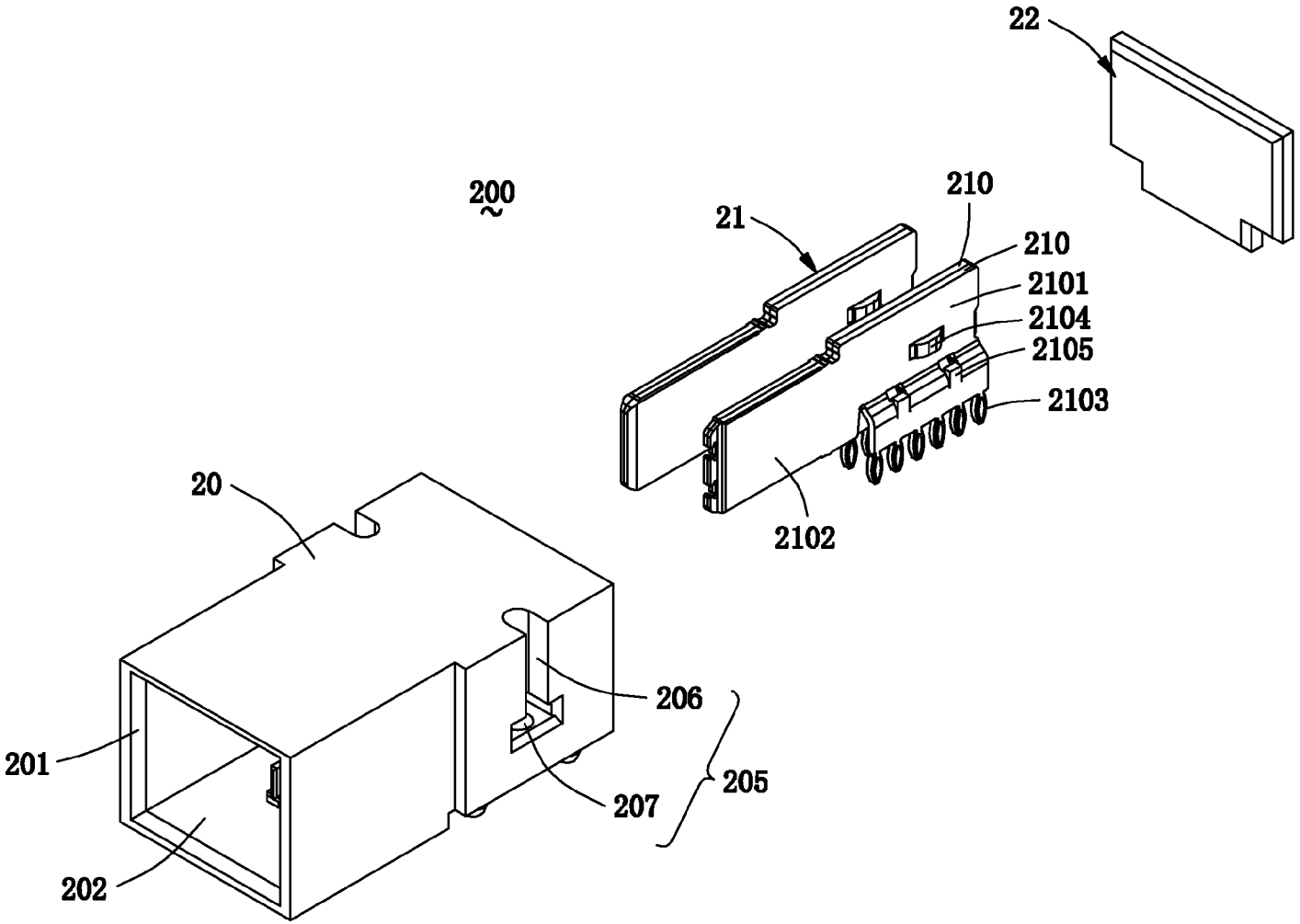
FIGS. 8 and 9 are exploded views of the double-sided pluggable power plug along different directions.
Figure 9:
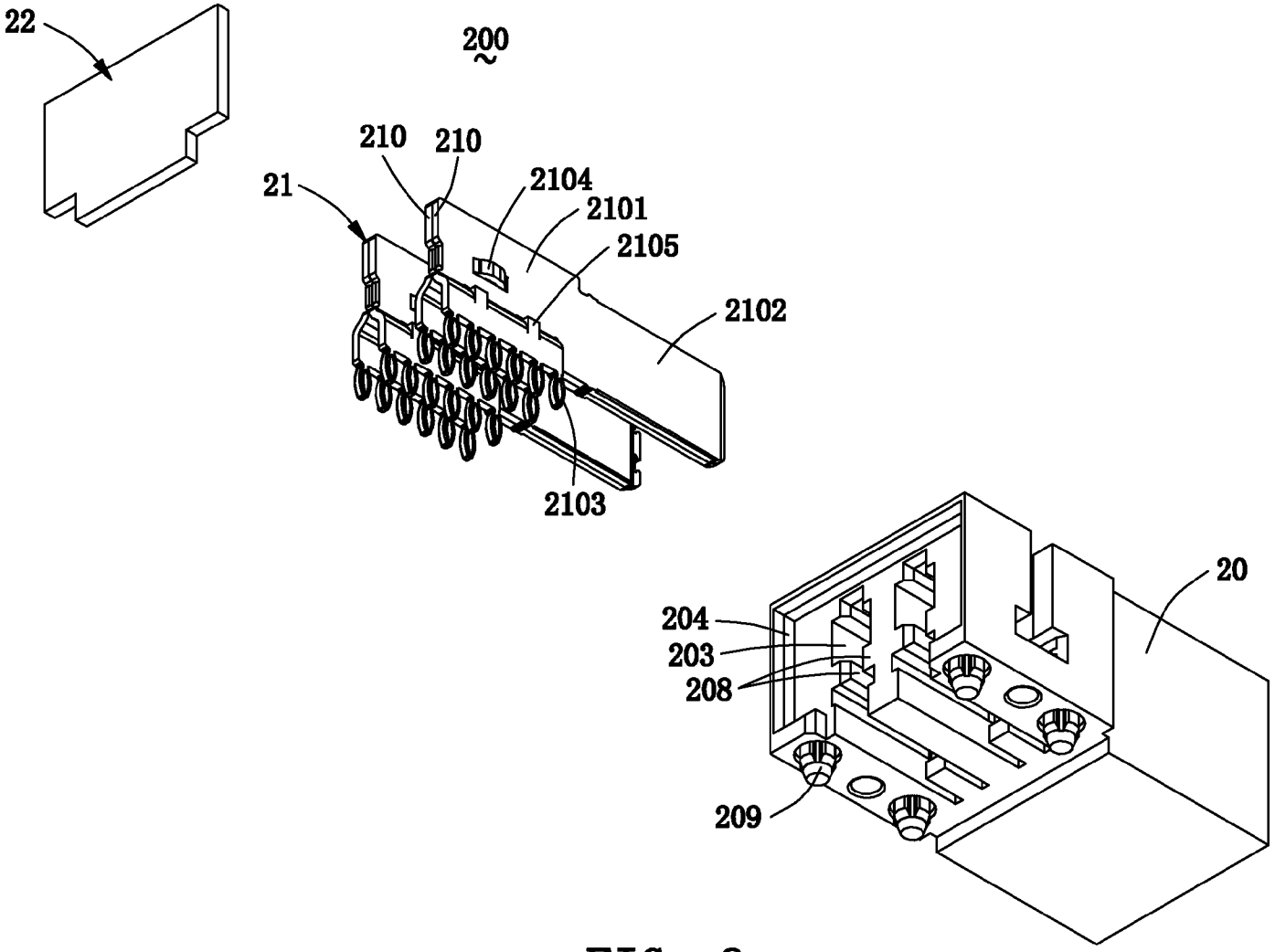

Please refer to FIGS. 8 and 9, the plug housing 20 has a rectangular plug port 201 on the front thereof, a receiving cavity 202 extending rearward from the plug port 201, and a pair of plug terminal-receiving passages 203 extending forward through the receiving cavity 202 from the rear of the plug housing 20 and extending downward through the bottom of the plug housing 20.

Referring to FIG. 9, the plug housing 20 further includes a plug recess 204 on the rear of the housing 20 for being used to receive the rear cover 22, and two plug-fixed structures 205 (label seen in FIG. 8) respectively on both sides of the housing 20 for being used to receive and fix a fastener 600 shown in FIG. 1. Therefore, the power plug 200 can be fixed on the first horizontal circuit board 400 by the fastener 600. In the embodiment, referring to FIG. 8, the plug-fixed structure 205 includes a lateral opening 206 and a through hole 207. The lateral opening 206 is favorable for the fastener 600 to be inserted into the through hole 207.

Moreover, referring to FIG. 9, each plug terminal-receiving passage 203 forms a pair of crossbeams 208 located on two sides thereof and spaced apart from each other. The plug housing 20 further includes several symmetrical fixed legs 209 on the bottom thereof for fixing the power plug 200 onto the first horizontal circuit board 400.

Please refer to FIGS. 8 and 9, each plug terminal 21 includes two conductive plates 210 symmetrically arranged and closely attached to each other. Each conductive plate 210 has a vertical plate 2101, a platelike engaged portion 2102 on the front of the vertical plate 2101, and a vertical tail 2103 being bent outward from the bottom of the vertical plate 2101 and extending downward. Further, the conductive plate 210 has a first fixed protrusion 2104 being formed on the vertical plate 2101 and protruding outward, and a pair of second fixed protrusions 2105 located under the first fixed protrusion 2104 and above the tail 2103. The so-called "protruding outward" means that the first fixed protrusion 2104 protrudes away from the pair of conductive plates 210.

Figure 5:
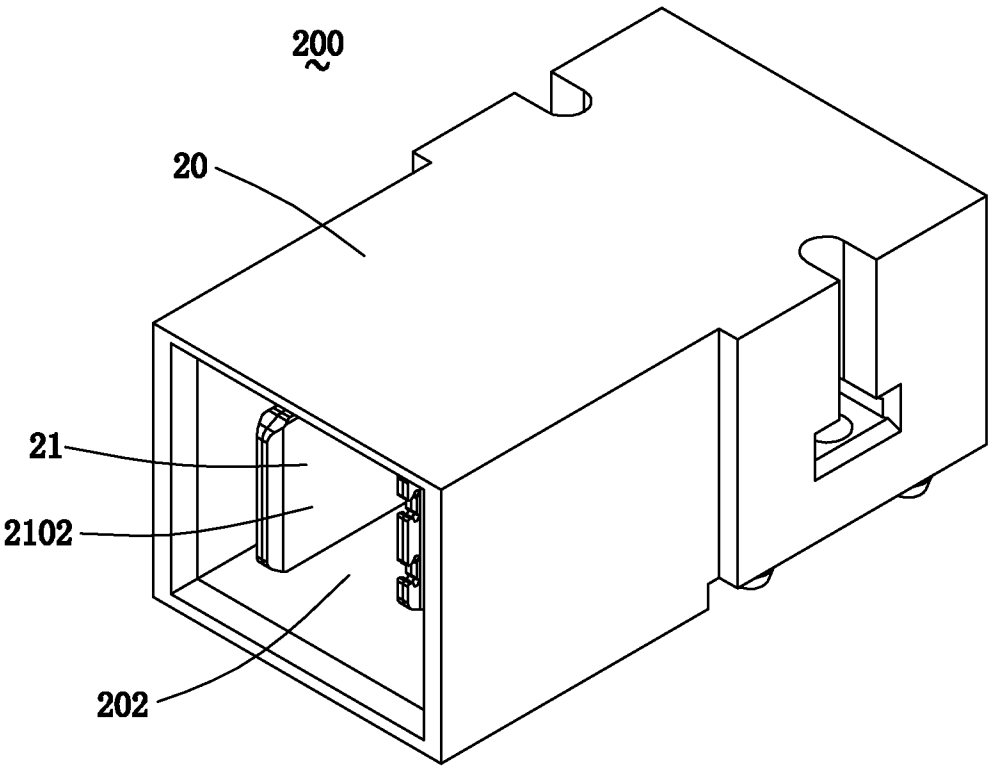
FIGS. 5 and 6 are perspective views of the double-sided pluggable power plug of the present invention along different directions.
Figure 7:
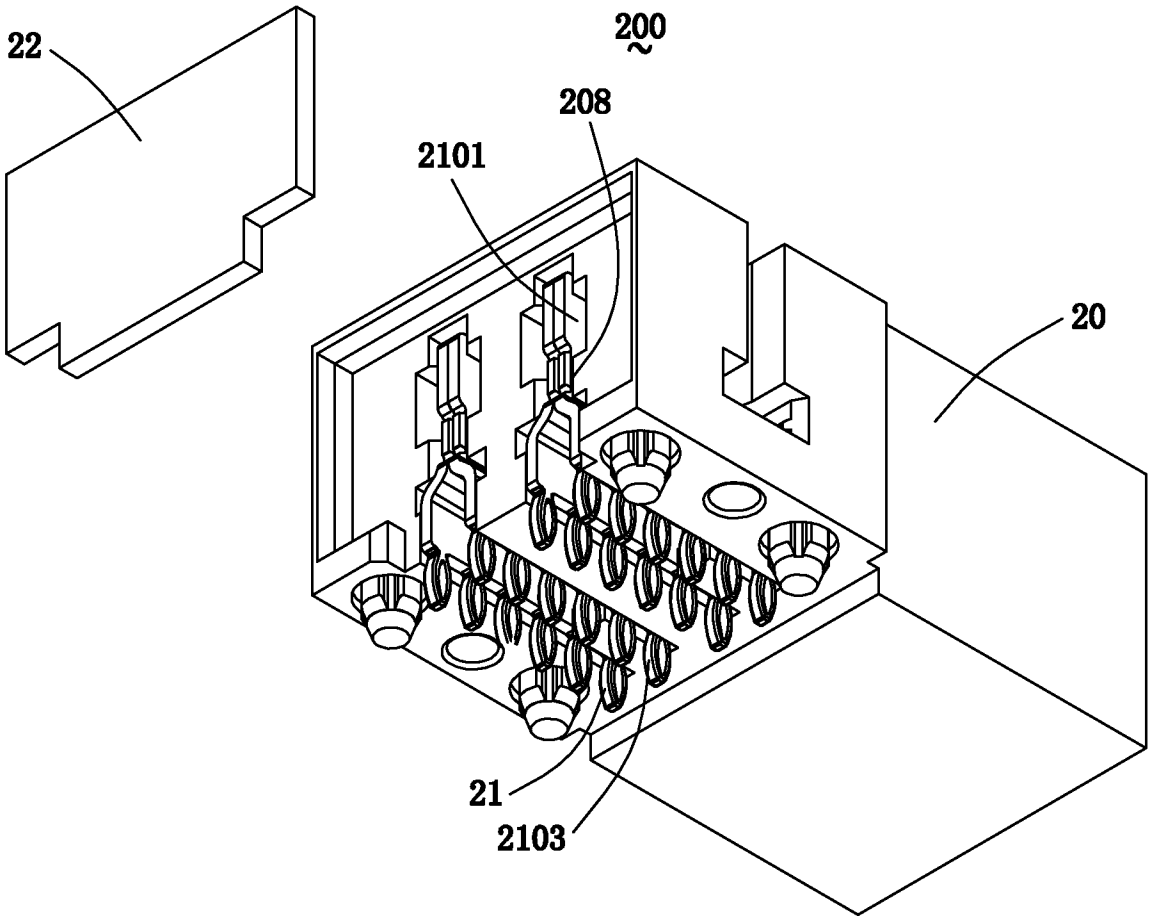
FIG. 7 is a schematic view of the double-sided pluggable power plug partially disassembled, and shows that a rear cover is disassembled from a plug housing.

Please refer to FIGS. 5 and 7, when the plug terminal 21 is mounted on the plug housing 20, the vertical plate 2101 is inserted into the corresponding plug terminal-receiving passage 203 and is clamped by the pair of crossbeams 208, the engaged portion 2102 enters into the receiving cavity 202, and the tail 2103 extends out of the bottom of the plug housing 20. The first fixed protrusion 2104 and the second fixed protrusion 2105 (label seen in FIG. 9) can clamp the corresponding crossbeam 208 in a vertical direction.

Please refer to FIGS. 17 to 20, in the other embodiment of the plug terminal 21 of the present invention, the plug terminal 21 further includes an insulation head 212, which may be plastic material and is disposed on the front of the engaged portions 2102 of the two conductive plates 210. The insulation head 212 can make the two conductive plates 210 be more compact. In the process of hot plug and pull, the insulation head 212 can also avoid the burning of the front of the plug terminal 21. In the embodiment, the insulation head 212 is directly formed at the front of the plug terminal 21 by an injection molding method thereby forming an integrated structure.

Please refer to FIGS. 17 to 20, in the other embodiment, the vertical plate 2101 of one conductive plate 210' further has a third fixed protrusion 2106 protruding toward the other conductive plate 210". The vertical plate 2101 of the other conductive plate 210" further has a rectangular opening 2107 for allowing the third fixed protrusion 2106 to enter therein. The two conductive plates 210 can be connected together by the engagement of the third fixed protrusion 2106 and the rectangular opening 2107. In the embodiment, referring to FIG. 19, the third fixed protrusion 2106 is located above the first fixed protrusion 2104, and the third fixed protrusion 2106 and the first fixed protrusion 2104 protrude along the opposite directions.

Figure 6:
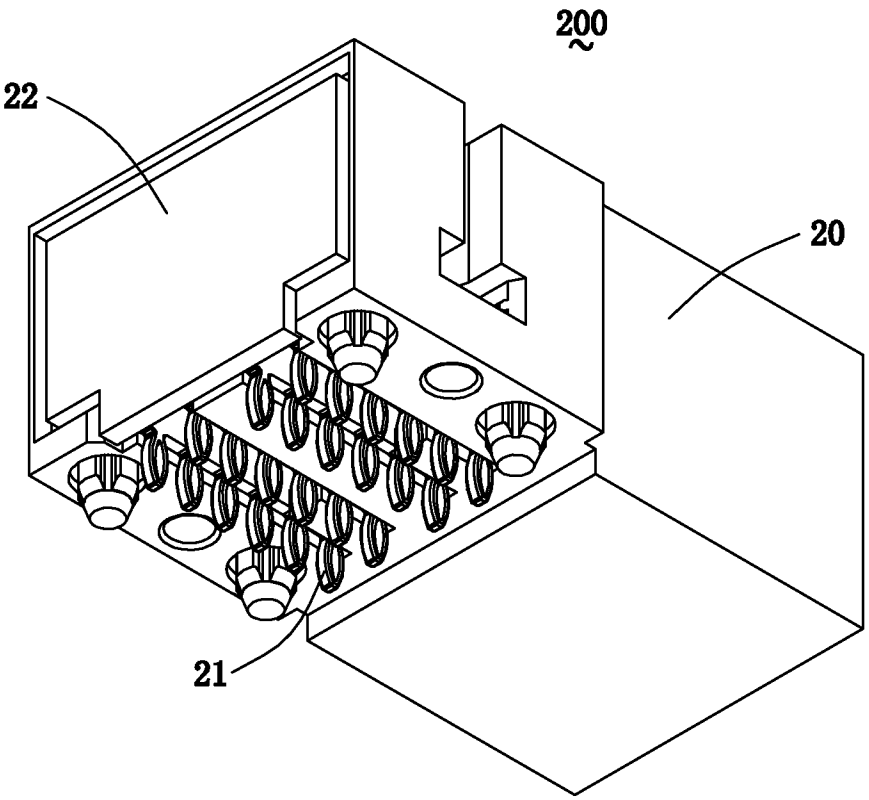

Referring to FIGS. 8 and 9, the rear cover 22 is T-typed and is mounted on the rear of the plug housing 20. The rear cover 22 is accommodated in the plug recess 204 to enclose the rear of the plug housing 20, as shown in FIG. 6.

Please refer to FIGS. 10 to 14, the power socket 300 includes a socket housing 30, a pair of socket terminals 31 and a rear plate 32.

Figure 13:
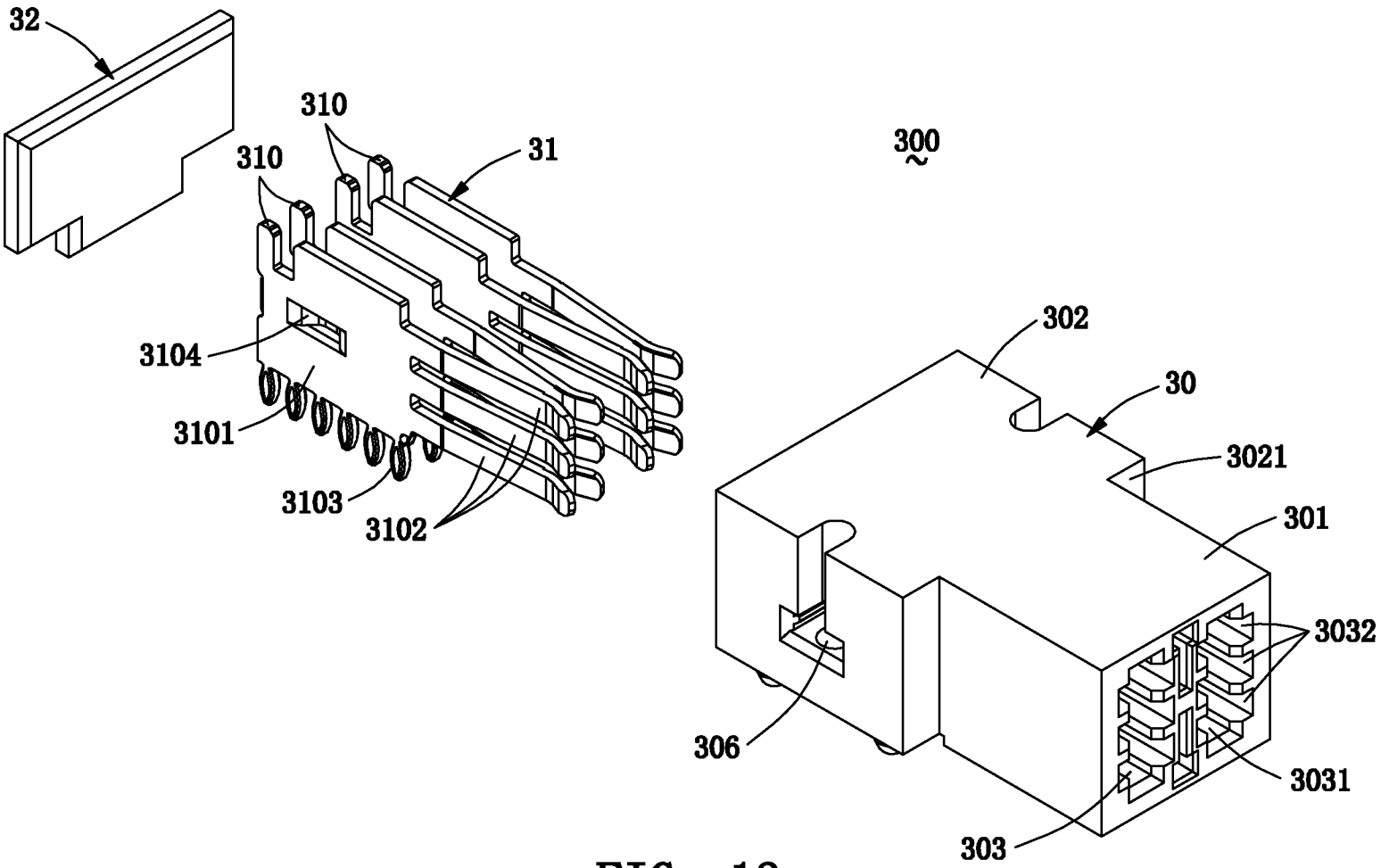
FIGS. 13 and 14 are exploded views of the double-sided pluggable power socket along different directions.
Figure 14:
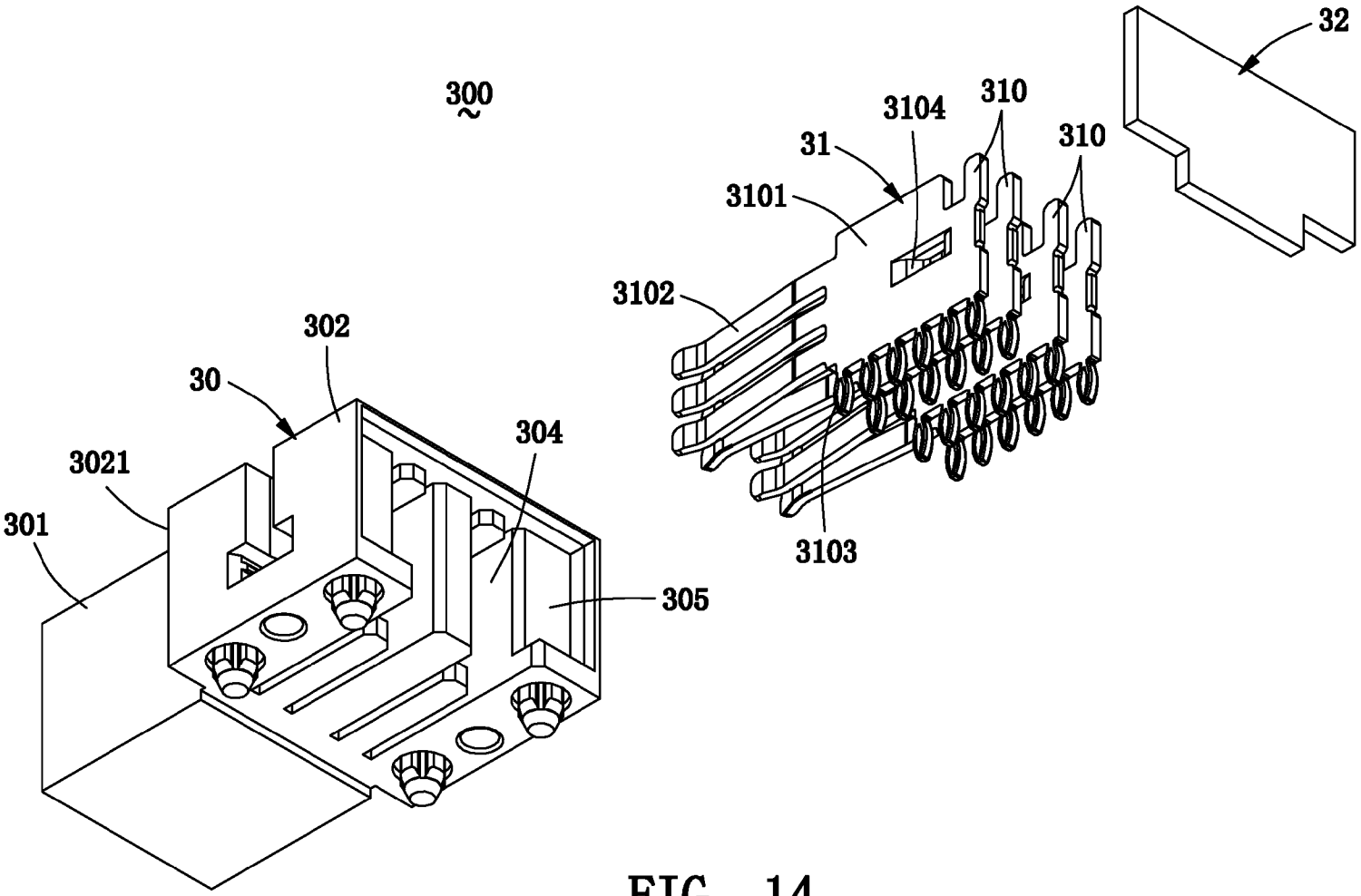

Referring to FIGS. 13 and 14, the socket housing 30 has an insertion part 301 with a square section in the front thereof, a mounting part 302 connected with the insertion part 301 in the rear thereof, a pair of socket ports 303 formed in the front of the insertion part 301, and a pair of socket terminal-receiving passages 304 extending forward from the rear of the mounting part 302 unto the socket port 303 and extending downward to pass through the bottom of the mounting part 302. The section size of the mounting part 302 is greater than that of the insertion part 301, so the mounting part 302 forms a shoulder 3021 next to the insertion part 301 for preventing the insertion part 301 from being inserted excessively.

Referring to FIG. 13, each socket port 303 includes an insertion hole 3031 in the middle thereof, and multiple long grooves 3032 symmetrically formed on two sides of the insertion hole 3031 and communicated with the insertion hole 3031.

Moreover, referring to FIG. 14, the socket housing 30 further has a socket recess 305 on the rear thereof to accommodate the T-shaped rear plate 32. The rear plate 32 is used to enclose the rear of the socket housing 30.

Referring to FIG. 13, the socket housing 30 further disposes two socket-fixed structures 306 respectively on both sides of the housing 30 for being used to receive and fix the fastener 600 shown in FIG. 1. The power socket 300 can be fixed onto the second horizontal circuit board 500 by the fastener 600.

Please refer to FIGS. 13 and 14, each socket terminal 31 includes two conductive pieces 310 symmetrically arranged. Each conductive piece 310 has a vertical part 3101, multiple elastic arms 3102 located on the front of the vertical part 3101 and formed by being bent, and multiple vertical end parts 3103 extending downward from the bottom of the vertical part 3101. The elastic arms 3102 of the two conductive pieces 310 form a clip for clamping the plug terminal 21 inserted later.

Furthermore, each conductive piece 310 also disposes a protrusion part 3104 on the vertical part 3101 for mechanically connecting the two conductive pieces 310 or making the two conductive pieces 310 contact each other. The protrusion parts 3104 of the two conductive pieces 310 can make the socket terminal 31 be an electrical whole. Specifically, the protrusion parts 3104 of the two conductive pieces 310 are disposed face to face.

Figure 10:
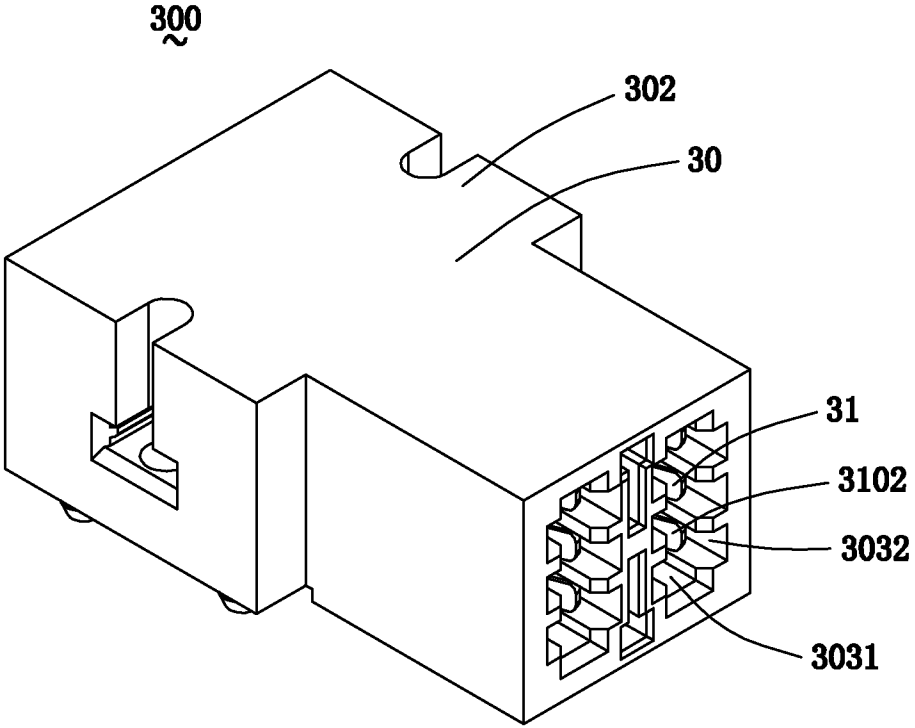
FIGS. 10 and 11 are perspective views of the double-sided pluggable power socket of the present invention along different directions.
Figure 11:
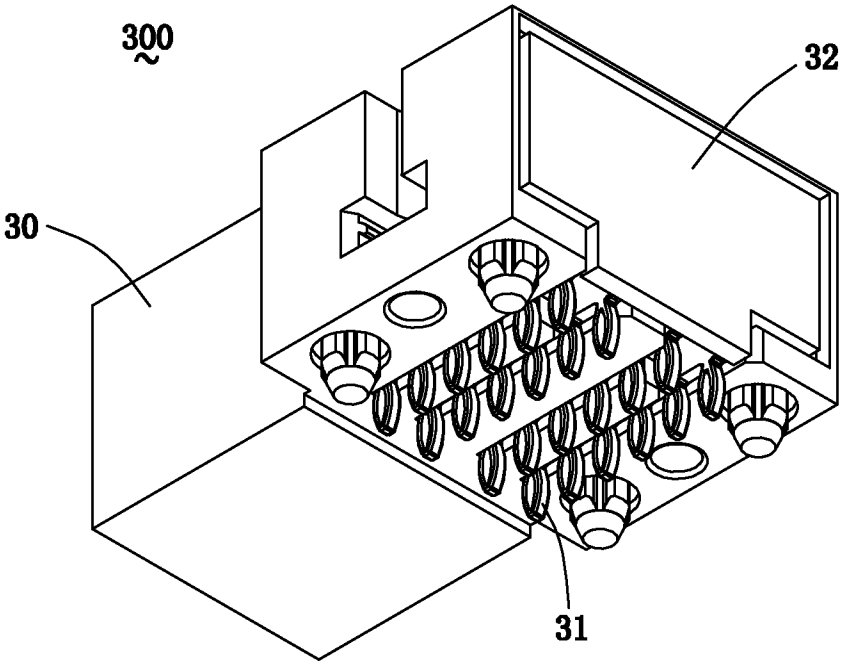
Figure 12:
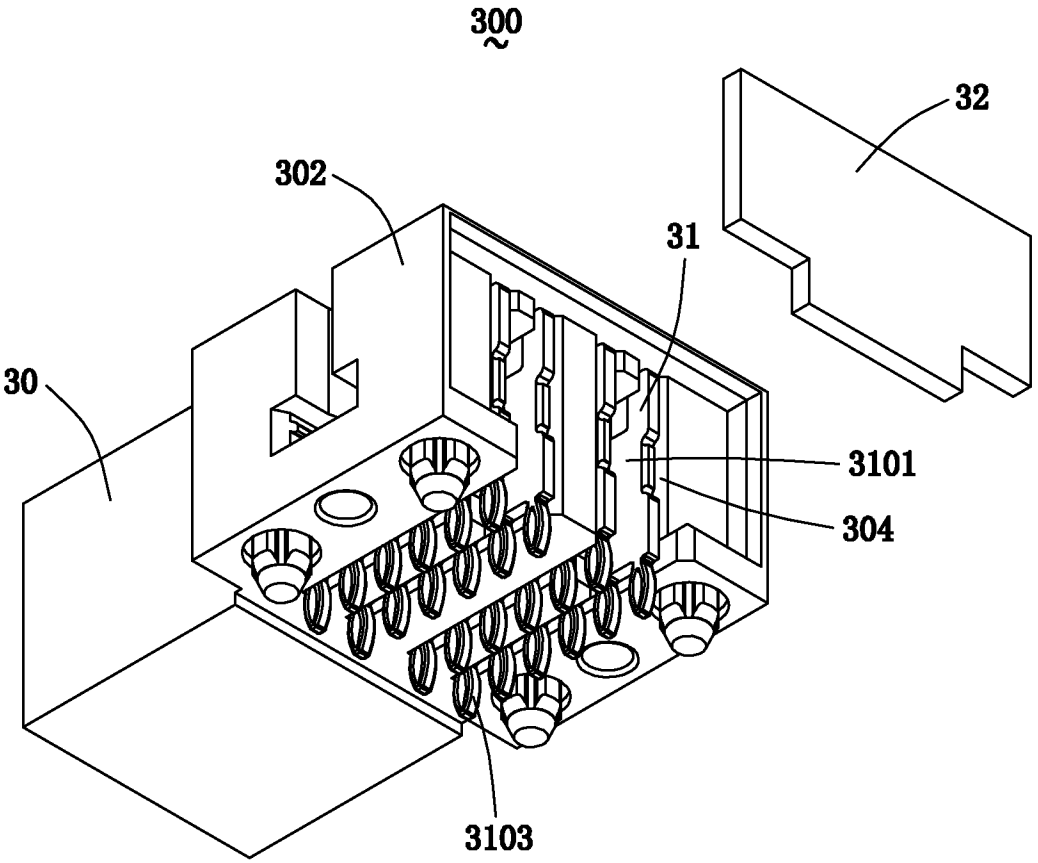
FIG. 12 is a schematic view of the double-sided pluggable power socket partially disassembled, and shows that a rear plate is disassembled from a socket housing.

Please refer to FIGS. 10 and 12, when the socket terminal 31 is mounted on the socket housing 30, the vertical part 3101 is inserted into the corresponding socket terminal-receiving passage 304; these elastic arms 3102 respectively enter into the corresponding long grooves 3032 and are exposed in the corresponding insertion hole 3031 for being ready to be engaged with the plug terminal 21 inserted later; and these end parts 3103 extend out of the bottom of the mounting part 302 of the socket housing 30 for being ready to be connected with the second horizontal circuit board 500 shown in FIG. 1.

Referring to FIGS. 1 and 2, when the power plug 200 and the power socket 300 are engaged with each other, the insertion part 301 of the socket housing 30 can be inserted into the receiving cavity 202 from the plug port 201 of the plug housing 20 by the obverse insertion mode. With the slow insertion of the insertion part 301, the two plug terminals 21 can be inserted into the corresponding insertion holes 3031 from the corresponding socket ports 303 (label seen in FIG. 13). Of course, the power plug 200 and the power socket 300 also can be engaged with each other by the reverse insertion mode, as shown in FIGS. 3 and 4.

Figure 15:
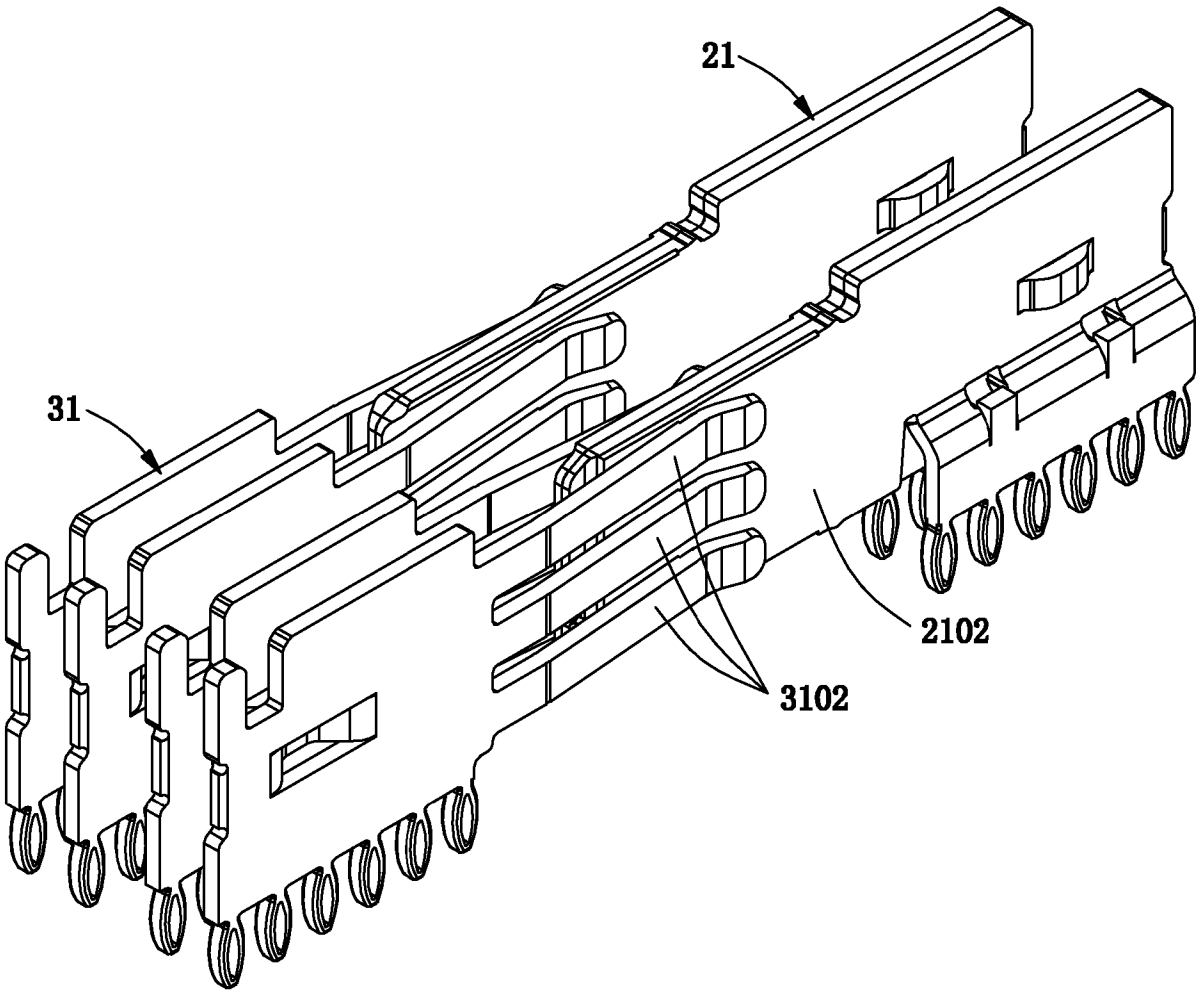
FIG. 15 shows an obverse insertion state of plug terminals and socket terminals.
Figure 16:
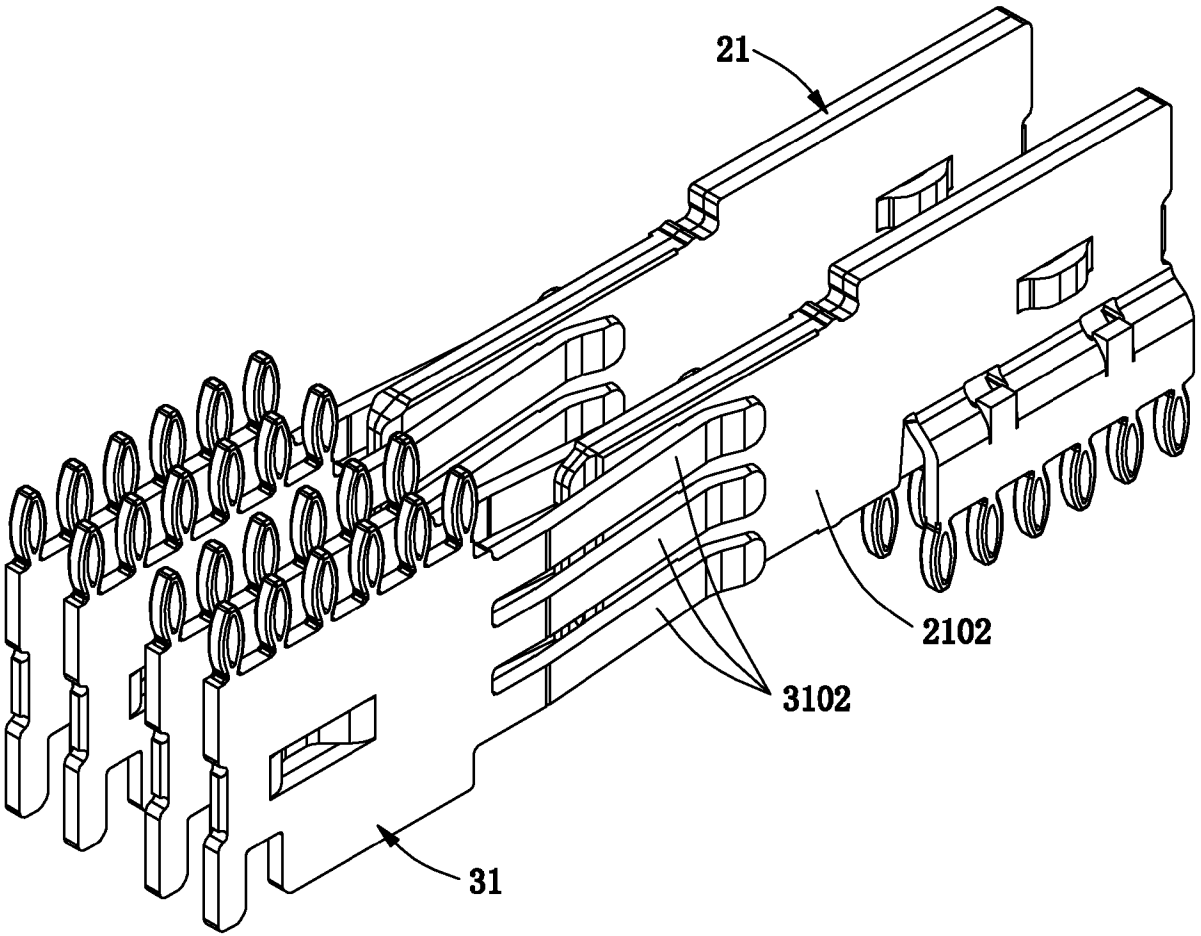
FIG. 16 shows a reverse insertion state of plug terminals and socket terminals.
Figure 17:
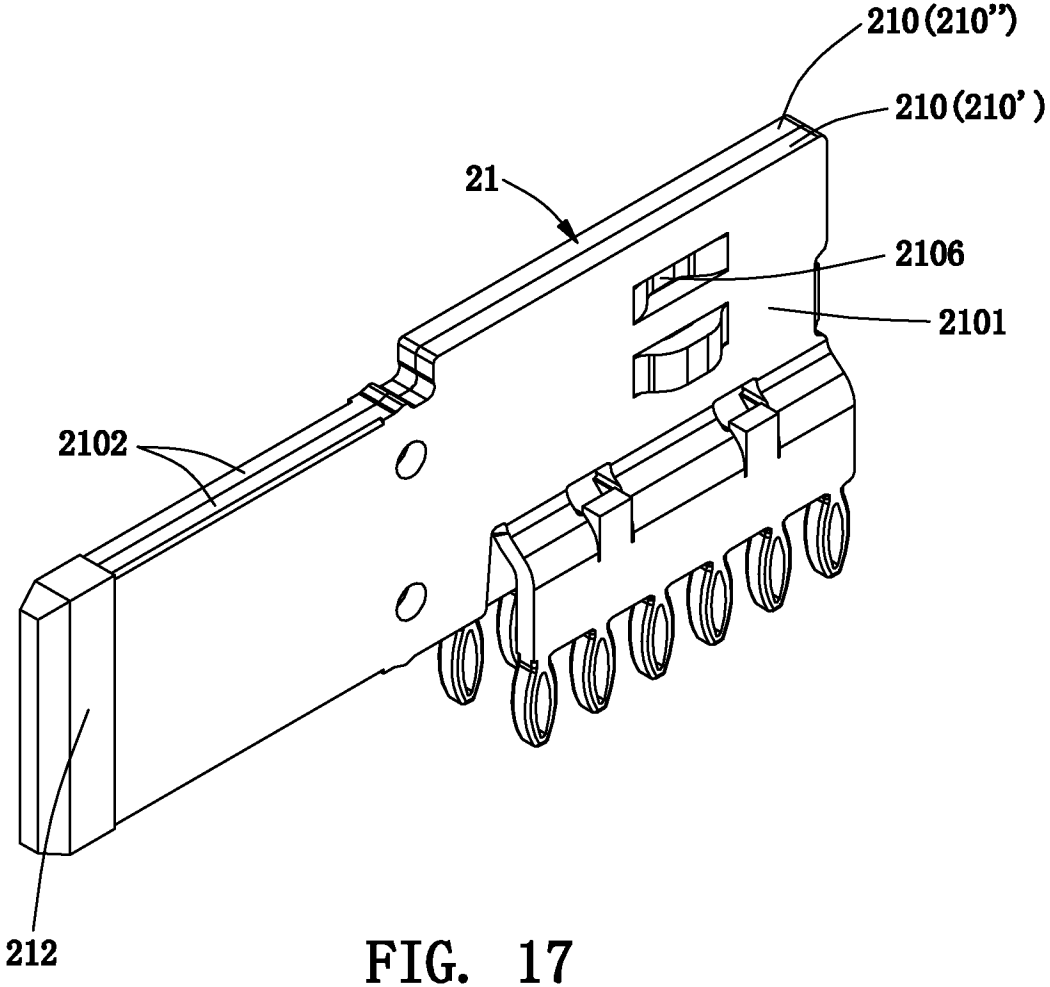
FIG. 17 is a schematic view of the plug terminal in the other embodiment.
Figure 18:
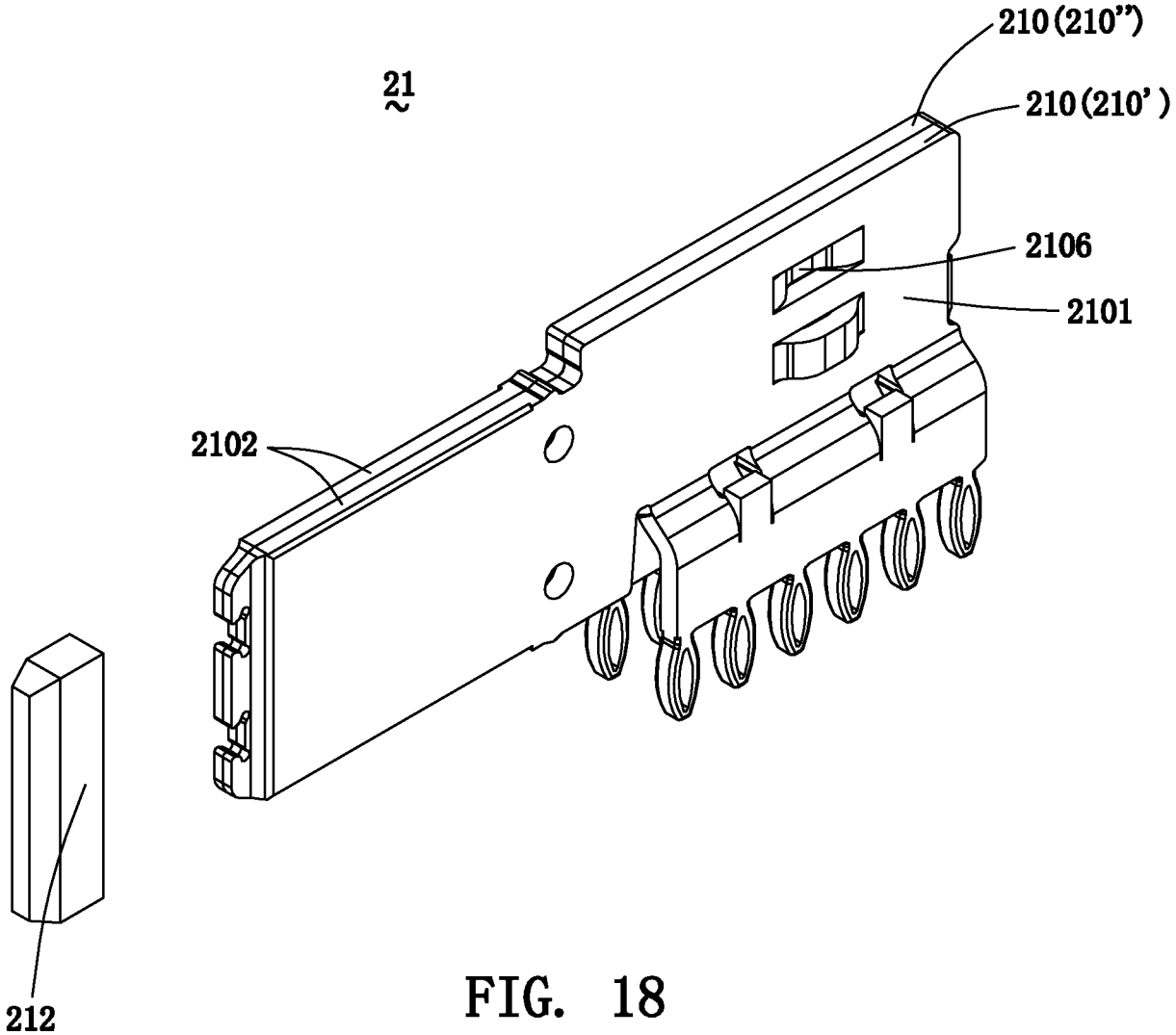
FIG. 18 is a partial exploded view of the plug terminal shown in FIG. 17.
Figure 19:
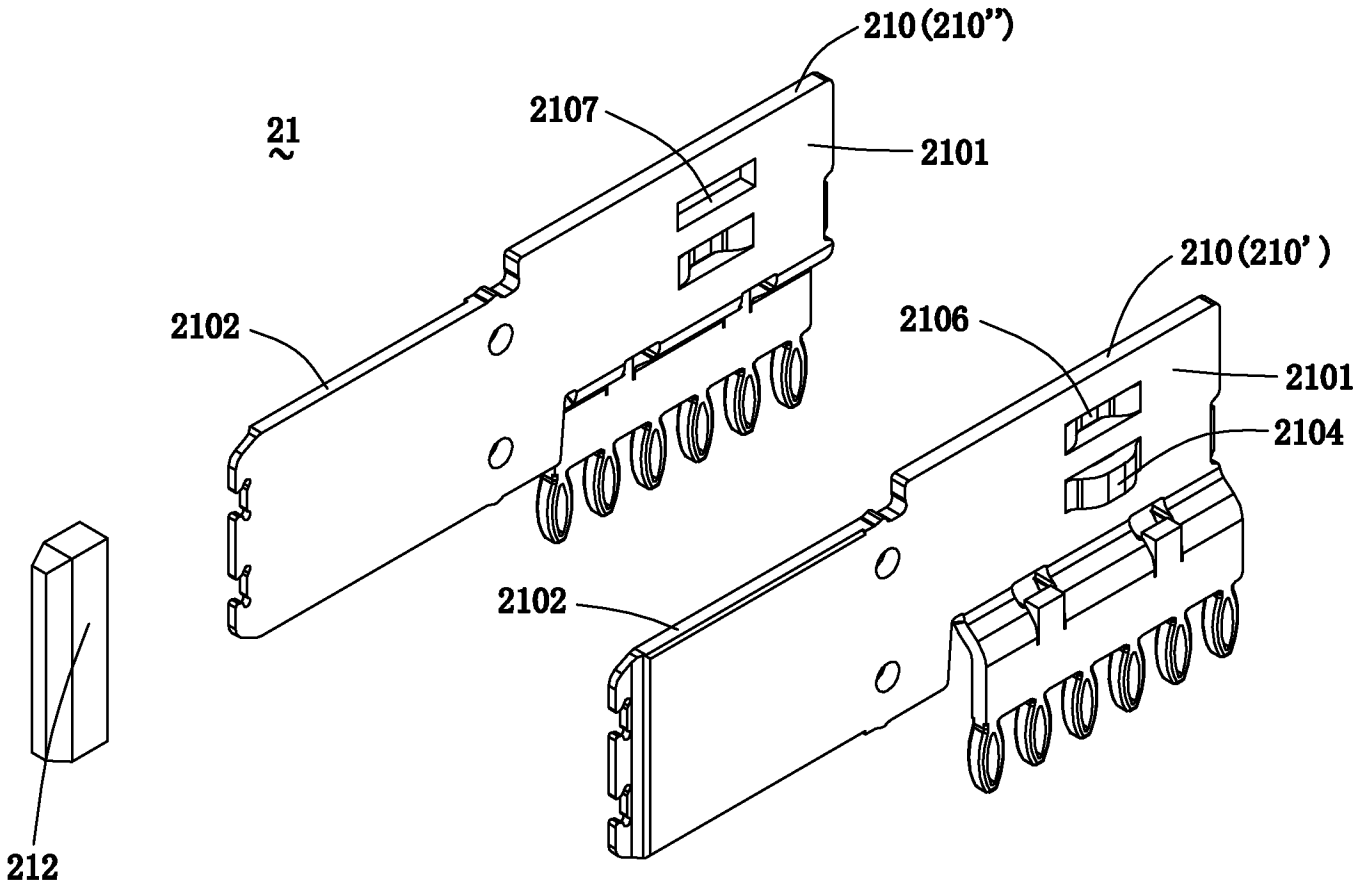
FIGS. 19 and 20 are exploded views of the plug terminal shown in FIG. 17 along different directions for clearly showing the detail structure thereof.
Figure 20:
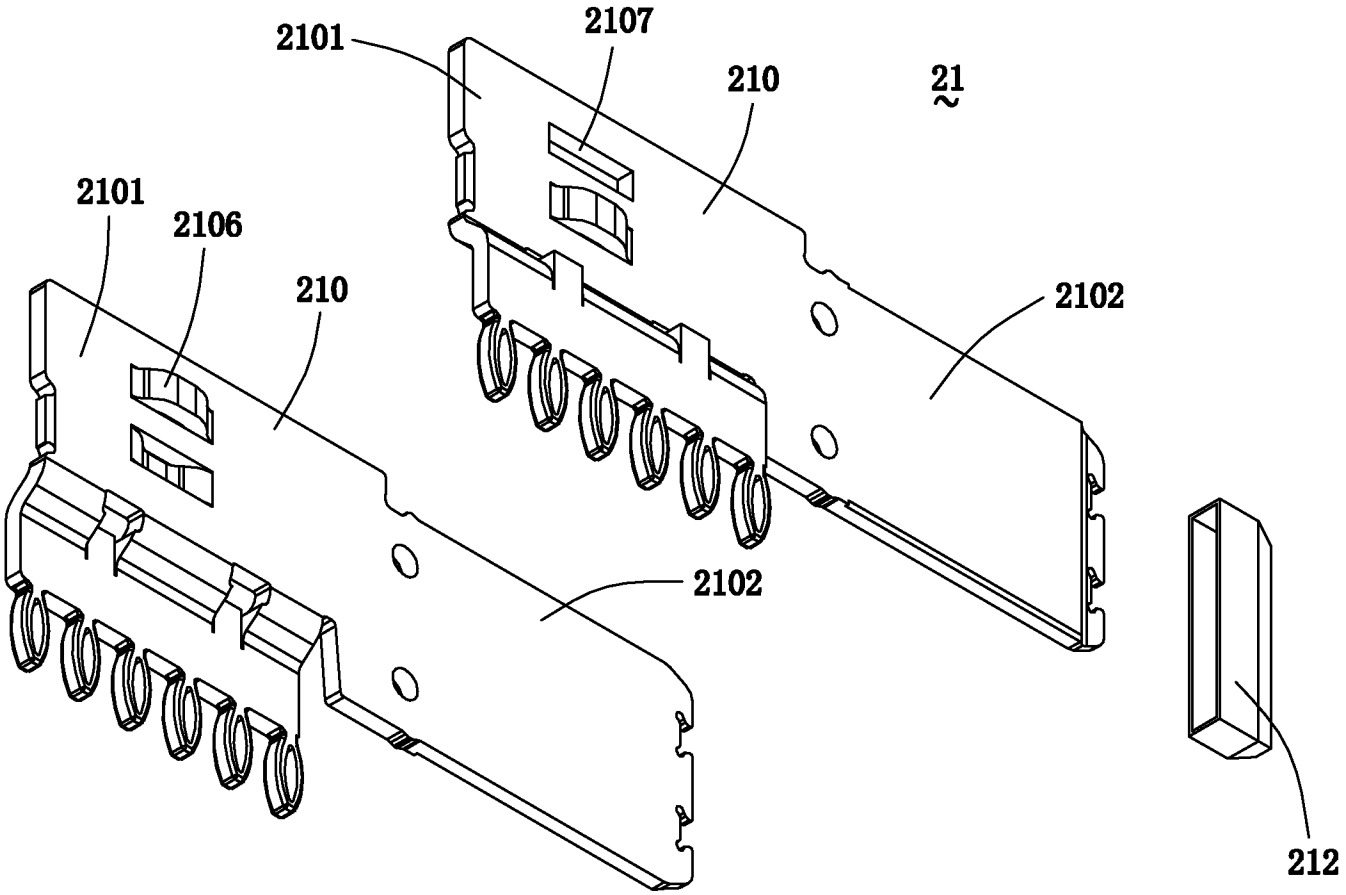

An obverse insertion state and a reverse insertion state of the socket terminals 31 and the plug terminals 21 are respectively shown in FIGS. 15 and 16. In the two insertion states, the engaged portions 2102 of the plug terminal 21 can be clamped by the elastic arms 3102 of the socket terminal 31, so that the socket terminal 31 and the plug terminal 21 may form a stable electrical contact.

As described above, the receiving cavity 202 of the power plug 200 is designed to be square in the present invention, and the insertion part 301 of the power socket 300 is designed to be square, therefore the square insertion part 301 can be obversely or reversely inserted into the square receiving cavity 202. Namely, the combination structure 100 of the present invention has the double-sided pluggable characteristic. Moreover, the plug terminal 21 of the power plug 200 employs the insulation head 212 to cover the front of the plug terminal 21, thereby making the plug terminal 21 be more compact, improving the strength of the plug terminal 21, and avoiding avoid the burning of the front of the plug terminal 21 in the process of hot plug and pull. In addition, in the other embodiment, the plug terminal 21 of the power plug 200 is provided with special mechanical connection structures, such as the third fixed protrusion 2106 and the rectangular opening 2107, which can make the plug terminal 21 be more firm and improve the stability of the whole structure.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A double-sided pluggable power plug, which comprises:

a plug housing having a rectangular plug port on the front thereof, a receiving cavity extending rearward from the plug port, and a pair of plug terminal-receiving passages extending forward through the receiving cavity from the rear of the plug housing and extending downward through the bottom of the plug housing; each plug terminal-receiving passage forming a pair of crossbeams located on two sides thereof and spaced apart from each other;

a pair of plug terminals mounted on the plug housing; each plug terminal including two conductive plates symmetrically arranged and closely attached to each other; each conductive plate having a vertical plate, a platelike engaged portion on the front of the vertical plate, and a vertical tail being bent outward from the bottom of the vertical plate and extending downward; the conductive plate further including a first fixed protrusion being formed on the vertical plate and protruding outward, and a pair of second fixed protrusions located under the first fixed protrusion and above the tail; and a rear cover mounted on the rear of the plug housing;

when the plug terminal is mounted on the plug housing, the vertical plate being inserted into the corresponding plug terminal-receiving passage and being clamped by the pair of crossbeams; the engaged portion entering into the receiving cavity; and the tail extending out of the bottom of the plug housing.

2. The double-sided pluggable power plug as claimed in claim 1, wherein the plug terminal further includes an insulation head disposed on the front of the engaged portions of the two conductive plates.

3. The double-sided pluggable power plug as claimed in claim 1, wherein the vertical plate of one conductive plate of the plug terminal has a third fixed protrusion protruding toward the other conductive plate; and the vertical plate of the other conductive plate has a rectangular opening for allowing the third fixed protrusion to enter therein.

4. The double-sided pluggable power plug as claimed in claim 1, wherein the plug housing further includes a plug recess on the rear of the plug housing; and the rear cover is T-typed and is accommodated in the plug recess.

5. The double-sided pluggable power plug as claimed in claim 1, wherein the plug housing further includes two plug-fixed structures respectively on both sides of the plug housing for being used to receive and fix a fastener.

6. A double-sided pluggable power socket, which comprises:

a socket housing having an insertion part with a square section in the front of the socket housing, a mounting part connected with the insertion part in the rear of the socket housing, a pair of socket ports formed in the front of the insertion part, and a pair of socket terminal-receiving passages extending forward from the rear of the mounting part unto the socket port and extending downward to pass through the bottom of the mounting part; each socket port including an insertion hole in the middle thereof, and multiple long grooves symmetrically formed on two sides of the insertion hole and communicated with the insertion hole; the mounting part forming a shoulder next to the insertion part;

a pair of socket terminals mounted on the socket housing; each socket terminal including two symmetrically arranged conductive pieces; each conductive piece having a vertical part, multiple elastic arms located on the front of the vertical part and formed by being bent, and multiple vertical end parts extending downward from the bottom of the vertical part; the elastic arms of the two conductive pieces forming a clip; each conductive piece further disposing a protrusion part on the vertical part for making the two conductive pieces contact each other; and a rear plate mounted on the rear of the socket housing;

when the socket terminal is mounted on the socket housing, the vertical part being inserted into the corresponding socket terminal-receiving passage; the elastic arms respectively entering into the corresponding long grooves and being exposed in the corresponding insertion hole; and these end parts extending out of the bottom of the mounting part of the socket housing.

7. The double-sided pluggable power socket as claimed in claim 6, wherein the socket housing further has a socket recess on the rear thereof; and the rear plate is T-shaped and is accommodated in the socket recess.

8. The double-sided pluggable power socket as claimed in claim 6, wherein the socket housing further disposes two socket-fixed structures respectively on both sides of the socket housing for being used to receive and fix a fastener.

9. A double-sided pluggable combination structure, which comprises:

a double-sided pluggable power plug comprising:

a plug housing having a rectangular plug port on the front thereof, a receiving cavity extending rearward from the plug port, and a pair of plug terminal-receiving passages extending forward through the receiving cavity from the rear of the plug housing and extending downward through the bottom of the plug housing; each plug terminal-receiving passage forming a pair of crossbeams located on two sides thereof and spaced apart from each other;

a pair of plug terminals mounted on the plug housing; each plug terminal including two conductive plates symmetrically arranged and closely attached to each other; each conductive plate having a vertical plate, a platelike engaged portion on the front of the vertical plate, and a vertical tail being bent outward from the bottom of the vertical plate and extending downward; the conductive plate further including a first fixed protrusion being formed on the vertical plate and protruding outward, and a pair of second fixed protrusions located under the first fixed protrusion and above the tail; and a rear cover mounted on the rear of the plug housing;

when the plug terminal is mounted on the plug housing, the vertical plate being inserted into the corresponding plug terminal-receiving passage and being clamped by the pair of crossbeams; the engaged portion entering into the receiving cavity; and the tail extending out of the bottom of the plug housing; and a double-sided pluggable power socket, which comprises:

a socket housing having an insertion part with a square section in the front of the socket housing, a mounting part connected with the insertion part in the rear of the socket housing, a pair of socket ports formed in the front of the insertion part, and a pair of socket terminal-receiving passages extending forward from the rear of the mounting part unto the socket port and extending downward to pass through the bottom of the mounting part; each socket port including an insertion hole in the middle thereof, and multiple long grooves symmetrically formed on two sides of the insertion hole and communicated with the insertion hole; the mounting part forming a shoulder next to the insertion part;

a pair of socket terminals mounted on the socket housing; each socket terminal including two symmetrically arranged conductive pieces; each conductive piece having a vertical part, multiple elastic arms located on the front of the vertical part and formed by being bent, and multiple vertical end parts extending downward from the bottom of the vertical part; the elastic arms of the two conductive pieces forming a clip; each conductive piece further disposing a protrusion part on the vertical part for making the two conductive pieces contact each other; and a rear plate mounted on the rear of the socket housing;

when the socket terminal is mounted on the socket housing, the vertical part being inserted into the corresponding socket terminal-receiving passage; these elastic arms respectively entering into the corresponding long grooves and being exposed in the corresponding insertion hole; and these end parts extending out of the bottom of the mounting part of the socket housing;

when the power plug and the power socket are engaged with each other, the insertion part of the power socket being obversely or reversely inserted into the receiving cavity from the plug port of the power plug; the plug terminals of the power plug being inserted into the corresponding insertion holes from the corresponding socket ports; and the engaged portions of each plug terminal being clamped by the elastic arms of the corresponding socket terminal;

whereby the power plug and the power socket forms a stable electrical contact therebetween.

10. The double-sided pluggable combination structure as claimed in claim 9, wherein the plug terminal further includes an insulation head disposed on the front of the engaged portions of the two conductive plates;

the vertical plate of one conductive plate of the plug terminal has a third fixed protrusion protruding toward the other conductive plate; and the vertical plate of the other conductive plate has a rectangular opening for allowing the third fixed protrusion to enter therein.

* * * * *